US005119280A

United States Patent [19]

Yang

[11] Patent Number: 5,119,280

[45] Date of Patent: Jun. 2, 1992

[54] MULTIPURPOSE FLASHLIGHT

[76] Inventor: Hank Yang, 27 Sec. 1, Kaifong St., Taipei, Taiwan

[21] Appl. No.: 782,476

[22] Filed: Oct. 25, 1991

[51] Int. Cl.[5] ..... F21L 7/00

[52] U.S. Cl. ..... 362/191; 362/183; 362/187; 362/200; 362/208; 362/86; 362/109; 362/253

[58] Field of Search ..... 362/157, 183, 186, 187, 362/191, 200, 208, 109, 119, 120, 253, 398, 86

[56] References Cited

U.S. PATENT DOCUMENTS 4,740,874 4/1988 Wylie et al. ..... 362/187 X 4,835,665 5/1989 Kao ..... 362/208 X

*Primary Examiner*—Stephen F. Husar

*Attorney, Agent, or Firm*—Fleit, Jacobson, Cohn, Price, Holman & Stern

[57] ABSTRACT

A multipurpose flashlight comprising a casing which defines therein a battery chamber for holding a battery set and a storage chamber for holding medicines or small accessories, a back cover detachably attached to said casing at the back which has magnets for mounting on a metal surface and a socket for connecting to an external power supply, an alarm and light source set detachably attached to said casing at the front which comprises a buzzer, an electronic circuit and a lamp holder for producing audio and visual signal, and a projector detachably attached to said alarm and light source set at the front and moved to control the operation of said electronic circuit. Electric shock generating device may be attached to the casing for body defense.

7 Claims, 3 Drawing Sheets

MULTIPURPOSE FLASHLIGHT

BACKGROUND OF THE INVENTION

The present invention relates to a multipurpose flashlight which is comprised of a casing having an alarm and light source set fastened therein and alternatively attached with a back cover, a projector and an electric shock generating device for different purposes.

A flashlight is generally comprised of a casing having a battery set and a light source fastened therein and controlled by a switch to produce light for illumination. Since a flashlight simply uses an internal battery set for power supply, it is not suitable for constant illumination. Further, a flashlight according to the conventional structure is simply for the purpose of illumination only and does not have any additional function.

SUMMARY OF THE INVENTION

The present invention has been accomplished to provide a multipurpose flashlight which can be alternatively used as a device for illumination, a device for body defense, a device for sending light signals for communication, or a device for sending audio alarm.

According to the present invention, there is provided a multipurpose flashlight which is generally comprised of a casing which defines therein a battery chamber for holding a battery set and a storage chamber for holding medicines or small accessories; a back cover detachably attached to said casing at the back which has magnets for mounting on a metal surface and a socket for connecting to an external power supply; an alarm and light source set detachably attached to said casing at the front which comprises a buzzer, an electronic circuit and a lamp holder for producing audio and visual signal; and a projector detachably attached to said alarm and light source set at the front and moved to control the operation of said electronic circuit. When the lens mount is moved to a front position, the electronic circuit is triggered, causing the buzzer to buzz and the lamp bulb on the lamp holder to flash. When the lens mount is moved backwards to a back position, the flashlight is used as a hand lamp. Further, an electric shock generating device may be attached to the casing for body defense.

DETAILED DESCRIPTION OF THE PREFERRED EMBODIMENT

Figure 1:
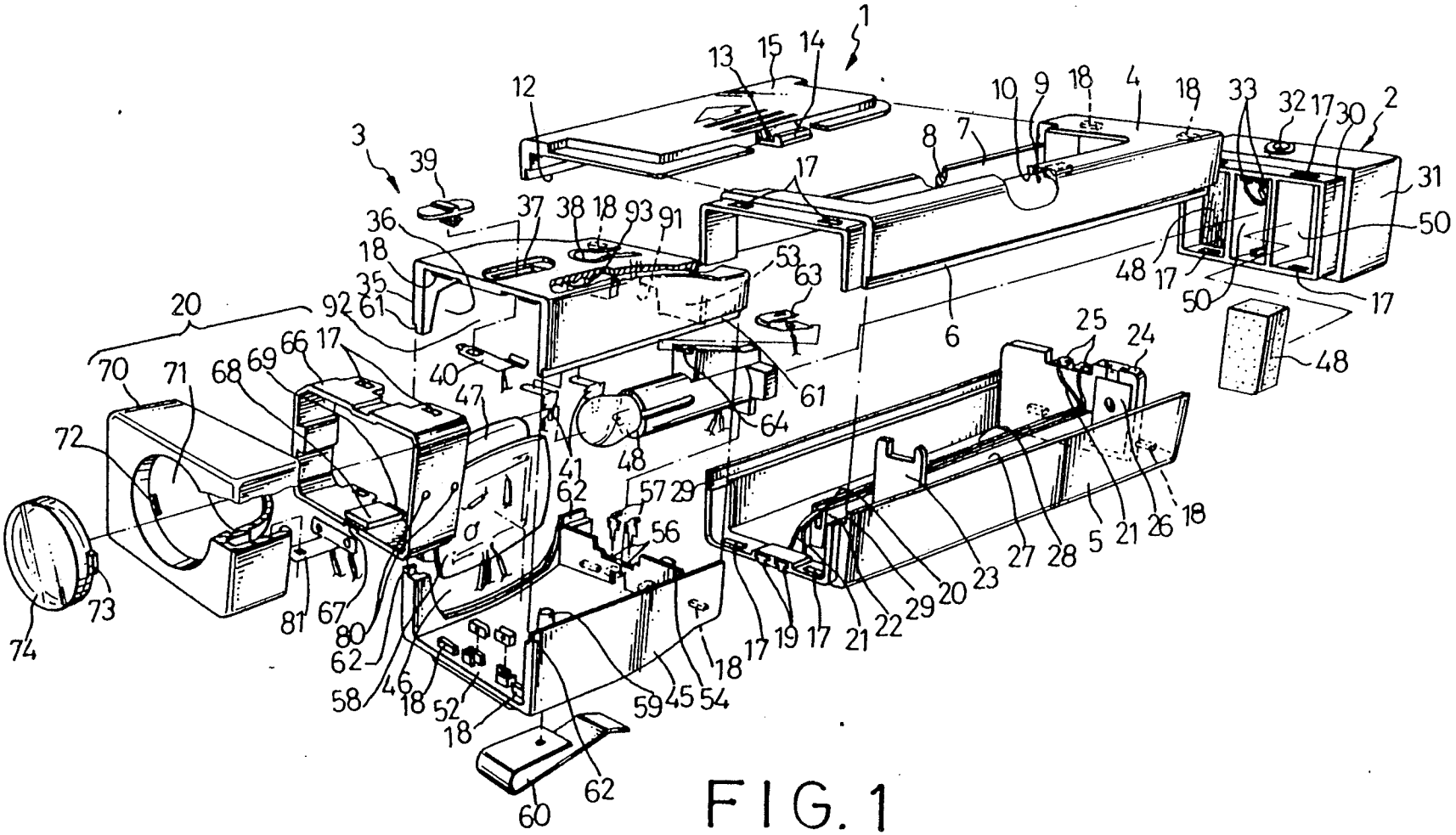
FIG. 1 is an exploded perspective view of a multipurpose flashlight embodying the present invention.
Figure 2:
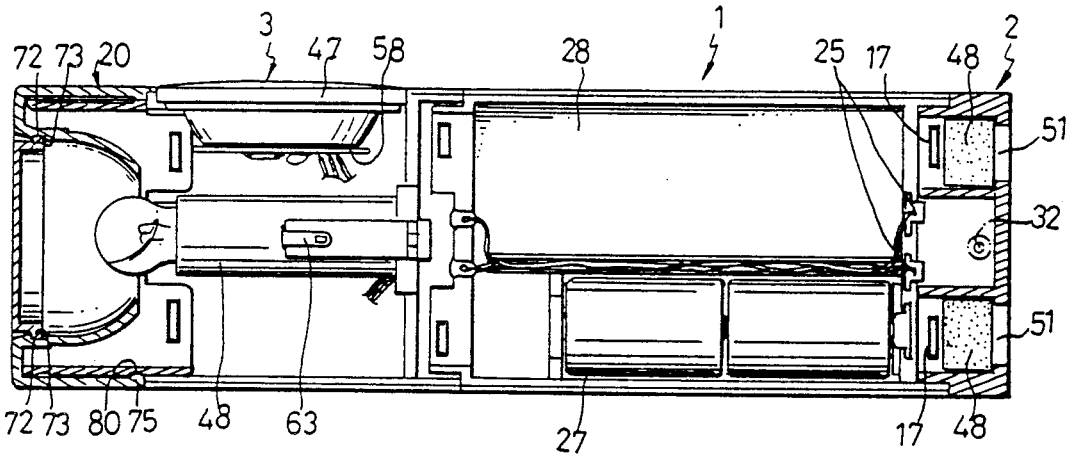
FIG. 2 is a schematic plan view showing that the lens mount is moved to the back position.
Figure 3:
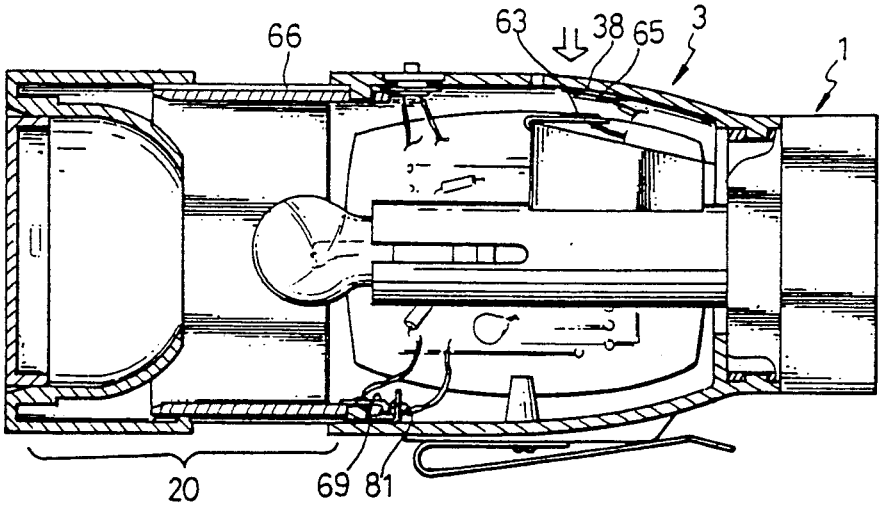
FIG. 3 is another schematic plan view showing that the lens mount is moved to the front position.
Figure 4:
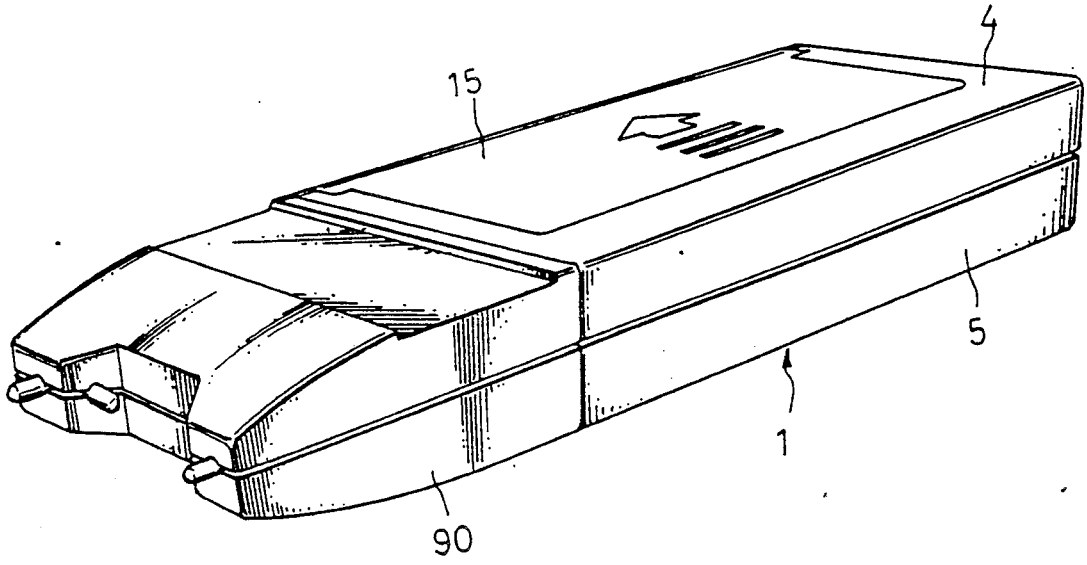
FIG. 4 illustrates an alternate form of the present invention in which an electric shock generating device is attached to the casing for body defense purpose.

Referring to the annexed drawings in detail, a multipurpose flashlight as constructed in accordance with the present invention is generally comprised of a casing 1, a back cover 2, an alarm and light source set 3, and a projector 20.

The casing is comprised of an upper shell 4, a bottom shell 5 and a lid 15. The upper shell 4 is made in a substantially U-shaped structure (when viewing from either end), having two spaced holes 17 at the front end thereof, two spaced raised portions 18 on the bottom surface at the front end thereof, an opening 7 at the middle, a substantially L-shaped edge 8 in said opening 7 at one side, and a hook 10 and a groove 9 in said opening 7 at an opposite side. The lid 15 has a substantially L-shaped edge 12 at one side, a groove 13 and a hook 14 at an opposite side. When the lid 15 is fastened in the opening 7, the L-shaped edge 8 on the upper shell 4 is engaged with the L-shaped edge 12 on the lid 15, the hooks 10, 14 are respectively hooked in the grooves 9, 13. Further, the upper shell 4 has two substantially L-shaped projecting strips 6 respectively extending outwards from the bottom edge thereof at two opposite sides. The bottom shell 5 is made in a substantially U-shaped structure (when viewing from either end), having two spaced holes 17 at one end, two wire holes 19 at the same end between said two spaced holes 17, and two spaced raised portions 18 on the upper surface thereof at an opposite end. A partition plate 22 which has a channel 20 therein is fastened inside the bottom shell 5 at a suitable position. A small partition plate 23 is fastened inside the bottom shell 5 between one side wall of the bottom shell 5 and the partition plate 22, which has a conductive strip (not shown) connected to either wire hole 19. A big partition plate 24 is fastened in the bottom shell 5 at the rear end thereof. The big partition plate 24 has a conductive strip 26 corresponding to the conductive strip on the small partition plate 23, and another two conductive strips 25 on the notched top edge thereof. Two electric wires 21 are received in the channel 20 on the partition plate 22 and respectively connected between the two wire holes 19 and the two conductive strips 25 on the notched top edge of the big partition plate 24. The conductive strip 26 on the big partition plate 24 and the conductive strip on the small partition plate 23 are respectively connected to the two conductive strips 25. Therefore, a battery chamber 27 is formed between the big partition plate 24 and the small partition plate 23, and a storage chamber 28 is formed inside the bottom shell 5 by the battery chamber 27. Further, the bottom shell 5 has two substantially L-shaped projecting strips 29 respectively extending outwards from the top edge thereof at two opposite sides. The projecting direction of the projecting strips 29 is in reverse to the projecting strips 6 on the upper shell 4. Therefore, when the upper shell 4 is attached to the bottom shell 5, the projecting strips 29, 6 are respectively engaged together.

The back cover 2 is comprised of a unitary small rectangular frame 30 formed inside a big rectangular frame 31. The back cover 2 has two partition plates 50 fastened therein which divide the holding space of the back cover 2 (namely, the small rectangular frame 30) into three slots 48, wherein the two slots 48 at two opposite sides each is fastened with a magnet 48. The big rectangular frame 31 has two holes 51 on the back side thereof relatively smaller than the slots 48, a socket 32 fastened therein at the top for connecting an external power supply. The small rectangular frame 30 has holes 17 on the top edge as well as the bottom edge thereof at two opposite locations, two conductive strips 33 on the internal wall surface thereof at the top respectively connected to the socket 32 on the big rectangular frame 31. The contact points of the conductive strips 33 are respectively exposed to the outside of the small rectangular frame 30. When the back cover 2 is attached to the casing 1 at the back, the raised portions 18 on the upper and bottom shells 4, 5 are respectively engaged into the holes 17 on the back cover 2 and, the conductive strips 33 are respectively disposed in contact with the conductive strips 25.

The alarm and light source set 3 comprises a housing consisted of an upper cover 35 and a bottom cover 45. The upper cover 35 has a big hole 36 at one side, an U-shaped opening 92 at the front end thereof, a stepped notch 91 on the back wall 53 thereof, and a sliding slot 37 and a signal control press button 38 at the top. The signal control press button 38 has a conductive strip 65 at the bottom connected to an electronic circuit 58 for producing intermittent connecting signal. A T-shaped, 3-step switch 39 is fastened in the sliding slot 37 and connected to a conductive strip 40 which is fastened inside the upper cover 35 beneath the sliding slot 37. There are three locating blocks 93 made on the inner wall surface of the upper cover 35 by the sliding slot 37, and two conductive strips 41 fastened in the gaps among said locating blocks 93 and respectively connected to a buzzer 47 and a lamp holder 48. When the 3-step switch 39 is shifted to the front position, it connects one conductive strip 41 causing the lamp bulb on the lamp holder 48 to produce light; when the 3-step switch 39 is shifted to the middle position, the circuit is off; when the 3-step switch 39 is shifted to the rear position, it connects the other conductive strip 41 causing the buzzer 47 to buzz. The upper cover 35 further comprises two L-shaped projecting strips 61 on the bottom edge thereof at two opposite sides for fastening the bottom cover 45, and two pairs of spaced, raised portions 18 on the inner wall surface thereof at two opposite ends. The bottom cover 45 has a big hole 46 at one side, an U-shaped opening 52 at the front end thereof, and a stepped notch 55 and two holes 56 on the back wall 54 thereof. Two conductive strips 57 are fastened in the holes 56 and respectively connected to the electronic circuit 58. The bottom cover 45 further comprises a column 59 at the top at a suitable location, two L-shaped projecting strips 62 on the top edge thereof at two opposite sides, and two pairs of spaced, raised portions 18 on the inner wall surface thereof at two opposite ends. A hooked spring plate 60 is secured to the column 59 by a screw and disposed at the outside of the bottom cover 45. There is also provided a conductive spring leaf 63 having one end inserted into a hole 64 on the lamp holder 48. Once the upper cover 35 and the bottom cover 45 are connected together with the L-shaped projecting strips 61, 62 respectively engaged with each other, the buzzer 47 and the electronic circuit 58 are retained between the holes 36, 46, and the rear end of the lamp holder 48 is retained between the stepped notches 55, 91 with the conductive spring leaf 63 disposed against the conductive strip 65 of the press button 38.

The projector 20 comprises a base frame 66, a lens mount 70 movably mounted on said base frame 66 to hold a lens 74. The base frame 66 has two recessed holes 80 at one side, two pairs of spaced holes 17 on the top and bottom edges thereof, a recess 67 on the outer wall surface thereof at the bottom, a fixed plate 68 fastened on the inner wall surface thereof at the bottom corresponding to said recess 67, and a conductive strip 69 secured to said fixed plate 68 at the back and connected to the electronic circuit 58. The lens mount 70 of the projector 20 has an opening 71 at the front, and two opposite holes 72 at the inside. The lens 74 is fastened in the opening 71, having two opposite projecting strips 73 respectively engaged into the holes 72. The lens mount 70 further has a raised portion 75 corresponding to the two recessed holes 80 on the base frame 66. By engaging the raised portion 75 into either of the two recessed holes 80, the lens mount 70 is firmly secured to the base frame 66 at a front or back position. There is also provided a substantially T-shaped conductive strip 81 having a front end inserted through the recess 67 and secured to the lens mount 70 and a rear end connected to the electronic circuit 58. When the lens mount 70 is pulled outwards and positioned at the front position, the conductive strip 81 is simultaneously moved forward with two contacts thereon respectively disposed in contact with the conductive strip 69 on the fixed plate 68, and therefore, the electronic circuit 58 is triggered to turn on the lamp bulb on the lamp holder 48. Further, when the lens mount 70 is moved to the front position, the raised portion 75 is engaged in the front recessed hole 80; when the lens mount is set back to the back position, the raised portion 75 is engaged in the back recessed hole 80.

By means of the arrangement of the casing 1, the back cover 2, the alarm and light source set 3 and the projector 20, the flashlight can be used for illumination as well as for giving an audio alarm or sending signals. An electric shock generating device 90 may be attached to the casing 1 forming into a device for body defense. When the back cover 2, the alarm and light source set 3 and the projector 20 are attached together, the socket 32 on the back cover 2 can be connected to the socket for cigarette lighter on the instrument board of an automobile. By moving the lens mount of the projector 20 to its front position and switching the 3-step switch 39 of the alarm and light source set 3 to its front position, the electronic circuit 58 of the alarm and light source set 3 is triggered to alarm and flash. By attaching the back cover 2, which has magnets 48 fastened therein, to an automobile's roof, the flashlight can be used as an alarm lamp. Therefore, the casing 1, the back cover 2, the alarm and light source set 3, the projector 20 and the electric shock generating device 90 can be alternatively combined into any of a variety of forms for different purposes.

What is claimed is:

1. A multipurpose flashlight comprised of a casing, a back cover, an alarm and light source set, and a projector, and characterized in that:

said casing defines therein a battery chamber and a storage chamber;

said back cover is detachably attached to said casing at one end, having at least one magnet fastened therein for securing the flashlight to a metal surface, and a socket for connecting to external power supply;

said alarm and light source set is detachably attached to said casing at an opposite end, and comprised of a buzzer, an electronic circuit, and a lamp holder; and said projector is detachably attached to said alarm and light source set at one end for projecting the light produced by said alarm and light source set.

2. The multipurpose flashlight according to claim 1, wherein said casing is comprised of an upper shell and a bottom shell, said bottom shell having a channeled partition plate, a big partition plate and a small partition plate respectively fastened therein and two electric contact ends at one end, said channeled partition plate, said big partition plate and said small partition plate being to divide the holding space in said casing into a battery chamber and a storage chamber, said big partition plate having two conductive strips fastened therein at the top and respectively connected to said two electric contact ends, said casing having a plurality of fastening holes on said upper and bottom shells at one end for fastening said alarm and light source set, and a plurality of raised portions on said upper and bottom shells at an opposite end for fastening said back cover.

3. The multipurpose flashlight according to claim 1, wherein said back cover is comprised of a unitary small rectangular frame formed inside a big rectangular frame, said small rectangular frame defining therein a first chamber at one side, a second chamber at an opposite side and a third chamber at the middle respectively divided by two partition plates, said big rectangular frame having two holes on the back wall thereof corresponding to said first and second chambers, said first and second chambers each having a magnet fastened therein, said back cover having a socket for connecting to the electric circuit of a car, a plurality of fastening holes for fastening the raised portions on said casing, and two conductive strips respectively connected to said socket for connecting the two conductive strips on said big partition plate of said casing.

4. The multipurpose flashlight according to claim 1, wherein said alarm and light source set comprises a housing having raised portions at two opposite ends for fastening said casing, said back cover or said projector, said housing being comprised of an upper cover and a bottom cover, said upper cover having a big hole at one side, a back wall, said back wall having a stepped notch, and a 3-step selector switch and a signal control press button at the top, said signal control press button having a conductive strip at the bottom connected to an electronic circuit, said bottom cover having a big hole at one side corresponding to the big hole on said upper cover, a back wall with a stepped notch and two small slots made thereon, two conductive strips respectively fastened in said two small slots and connected to said electronic circuit, a buzzer connected to said electronic circuit and retained in the big holes on said upper and bottom covers, a lamp holder retained between the stepped notches on said upper and bottom covers, said lamp holder having a conductive strip fastened therein for connecting the conductive strip on said signal control press button.

5. The multipurpose flashlight according to claim 1, wherein said projector is comprised of a base frame, and a lens mount movably mounted on said base frame to hold a lens, said base frame having two recessed holes at one side, a plurality of fastening holes for fastening said alarm and light source set, a recess on the outer wall surface thereof at the bottom, a fixed plate fastened on the inner wall surface thereof at the bottom corresponding to said recess, and a conductive strip secured to said fixed plate at the back and connected to said electronic circuit, said lens mount having an opening at the front and two opposite holes at the inside for holding a lens, said lens having two opposite projecting strips respectively engaged into the two opposite holes in said lens mount, a raised portion alternatively engaged in either of the two recessed holes on said base frame permitting said lens mount to be positioned at a front position or a back position, a T-shaped conductive strip having a front end inserted through said recess and secured to said lens mount and a rear end for connecting to said electronic circuit.

6. The multipurpose flashlight according to claim 1, wherein said projector and said back cover can be directly attached to said alarm and light source set at two opposite ends.

7. The multipurpose flashlight according to claim 1, which further comprises an electric shock generating device directly attached to said casing at one end.

* * * * *